United States Patent [19]

Standiford

[11] 3,991,675

[45] Nov. 16, 1976

[54] CLAMPING SADDLES FOR THIN FLEXIBLE PRINTING PLATES

[76] Inventor: Fred W. Standiford, 22577 Margarita Drive, Woodland Hills, Calif. 91364

[22] Filed: Apr. 1, 1971

[21] Appl. No.: 130,090

[52] U.S. Cl. ..... 101/415.1; 101/378

[51] Int. Cl.[2] ..... B41F 13/10

[58] Field of Search ..... 101/415.1, 378

[56] References Cited

UNITED STATES PATENTS

| | | | |
|---|---|---|---|
| 747,213 | 12/1903 | Pancoast | 101/415.1 |
| 1,965,621 | 7/1934 | Warwick | 101/415.1 |
| 1,966,121 | 7/1934 | Hotchkiss | 101/415.1 |
| 2,137,851 | 11/1938 | Nelson et al. | 101/415.1 |
| 2,512,940 | 6/1950 | Janke | 101/415.1 |
| 2,937,593 | 5/1960 | Ritzerfeld et al. | 101/415.1 |
| 2,963,969 | 12/1960 | Sauberlich | 101/415.1 |
| 3,228,329 | 1/1966 | Mangus et al. | 101/378 |
| 3,470,817 | 10/1969 | Heimlicher et al. | 101/378 |
| 3,537,395 | 11/1970 | Prince | 101/378 |
| 3,587,464 | 6/1971 | Wessels | 101/415.1 |

*Primary Examiner*—Edward M. Coven
*Attorney, Agent, or Firm*—Trask & Britt

[57] ABSTRACT

A clamping device for securing a thin flexible printing plate with longitudinally extending first and second opposite side edges to the cylinder of a rotary printing press, said clamping device including a semi-cylindrically shaped saddle adapted to be fixedly secured to said rotary press cylinder and to support said flexible printing plate on the saddle's outside face between the first and second longitudinally extending side edges of said saddle, securing means positioned along the first side edge of said saddle for securing the first side edge of the flexible printing plate to said saddle, a rotatable support member journaled to and along the second side edge of said saddle, a plurality of outwardly extending register pins secured to said support member to coact with openings formed along the second side edge of said flexible plate, and a lever secured to said support member for rotating said member to a position such that the register pins extend outwardly away from the second side edge of the saddle to lock said flexible plate on the saddle.

10 Claims, 7 Drawing Figures

INVENTOR.
Fred W. Standiford
BY C. Haweffold

INVENTOR.
Fred W. Standiford
BY C. Harry Gold
His Attorney

CLAMPING SADDLES FOR THIN FLEXIBLE PRINTING PLATES

BACKGROUND OF THE INVENTION

Rotary printing presses are in common use today, especially in the newspaper business. Such presses employ rotating cylinders which were originally designed for use with metal stereotype plates having relatively thick dimensions. Accordingly, with the advent of photo composition and the flexible, relatively thin plates which are now being employed rather than the metal stereotype plates, the need has arisen for means to secure the thin flexible plates to the rotating cylinders of a press. A description of the various attempts employed to attach the thin plates to rotary press cylinders is found in U.S. Pat. No. 3,537,395. It is the principal objective of the present invention to provide an improved arrangement for quickly and securely mounting relatively thin flexible printing plates on the printing cylinder of a rotary printing press designed for stereotype plates.

Still another object of the present invention is to provide an improved clamping saddle for mounting relatively thin flexible printing plates to the printing cylinder of a rotary printing press which securely locks the printing plate in an operative position when the printing cylinder is rotated and which allows ready removal of the printing plate without special tools being required to effectuate the removal.

BRIEF DESCRIPTION OF THE INVENTION

The present invention comprises a clamping device for securing a thin flexible printing plate with longitudinally extending first and second opposite side edges to the cylinder of a rotary printing press. The clamping device includes a saddle adapted to be fixedly secured to the cylinder of a rotary press to support such a flexible printing plate on the outwardly extending face (between first and second longitudinally extending side edges) of said saddle. Securing means are positioned along the first side edge of said saddle for securing the first side edges of said flexible printing plate to said saddle. A rotatable support member is journaled to and extends along the second side edge of said saddle; and a plurality of outwardly extending register pins are secured to said support member to coact with openings formed along the second side edge of said flexible plate. Rotation means are secured to said support member for rotating it to a position such that said register pins extend outwardly away from said second side edge of said saddle, thereby locking said flexible plate on said saddle.

In a preferred embodiment of the invention the rotation means comprises a lever fixedly secured to the support member, and stop means are provided in combination with said saddle to prevent said lever from rotating in a direction outwardly away from the outside surface of said saddle.

In a highly preferred embodiment of the invention, the securing means positioned along the first side edge of said saddle comprises a plurality of outwardly extending register pins sized to coact with openings positioned along the first side edge of the flexible printing plate.

BRIEF DESCRIPTION OF THE DRAWINGS

So that the invention may be more readily understood and carried into effect, reference is made to the accompanying drawings which are offered by way of example only and are not to be taken as limiting the invention, the scope of which is defined by the appended claims which are intended to embrace equivalent structures and methods.

DESCRIPTION OF THE PREFERRED EMBODIMENT

Figure 1:
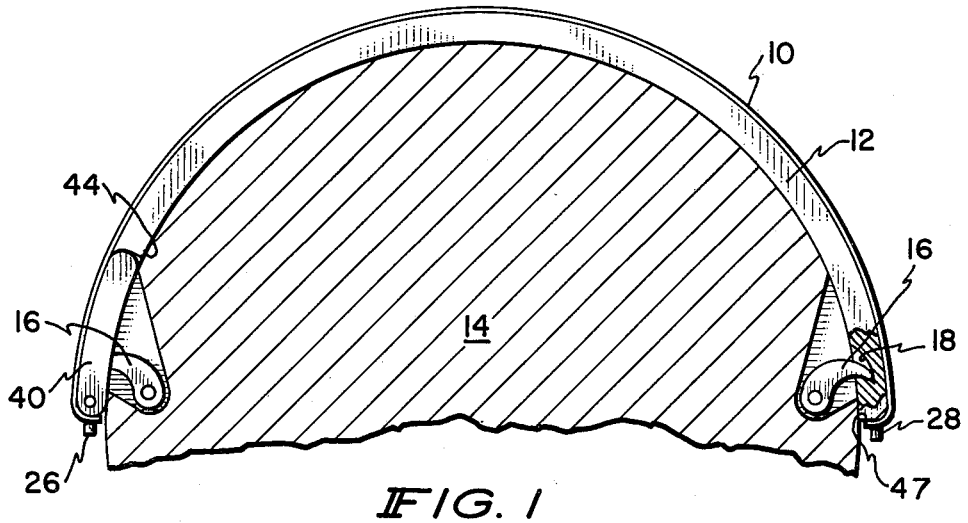
FIG. 1 is a cross-sectional end view of a cylinder of a rotary printing press with the clamping saddle and flexible printing plate of the invention mounted thereon in an assembled relationship. For purposes of clarity a portion of the clamping saddle is shown broken away.
Figure 2:
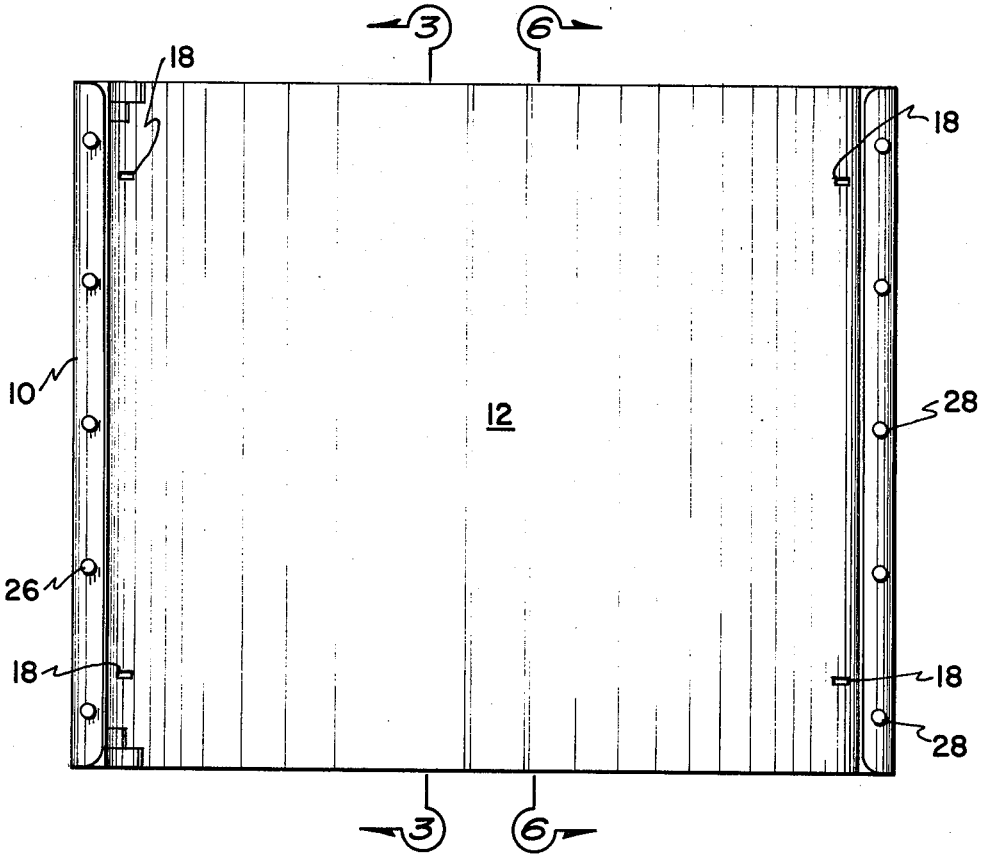
FIG. 2 is a bottom view of the clamping saddle with a flexible printing plate affixed thereto.

Referring now more particularly to the drawings, as shown in FIG. 1 a flexible printing plate 10 is mounted on a semi-cylindrically shaped, substantially rigid, clamping saddle 12 which in turn is removably secured to a printing cylinder 14 of a rotary printing press. Preferably, saddle 12 is formed as a unitary structure. The printing cylinder 14 is equiped with either fingers 16 for tensional lock-up with saddle 12 by extension into grooves 18 in said saddle or with conventional compression lock-up with contacting rings not shown in the drawings, which are positioned around the circumference of saddle 12 when it is mounted on cylinder 14. The thin flexible printing plate 10 is provided with a plurality of register pin openings 20 along its respective opposite straight traverse edges 22 and 24 each sized to receive a register pin 26 or 28 affixed to the opposite traverse edges of clamping saddle 12 as hereinafter described in detail.

Figure 3:
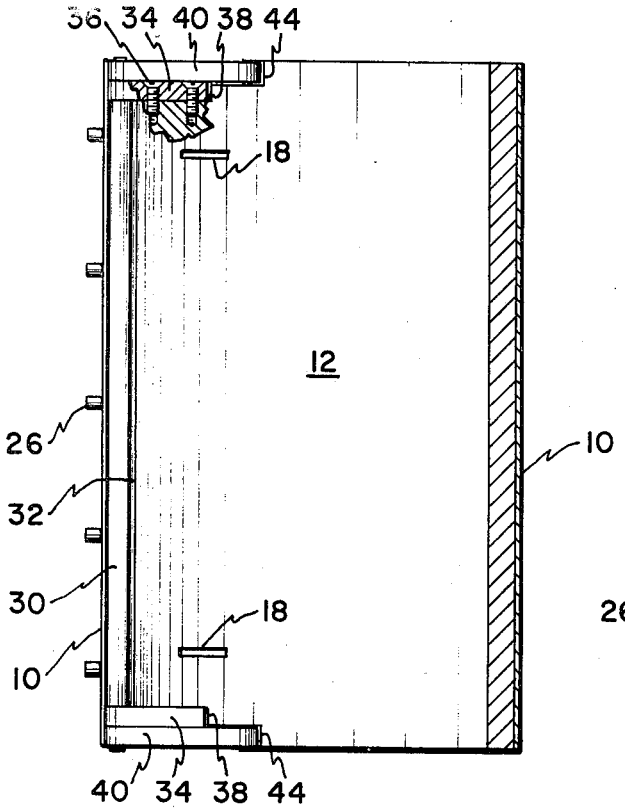
FIG. 3 is a sectional view of FIG. 2 taken in the plane of line 3—3 looking in the direction of the arrows. For purposes of clarity a portion of the clamping saddle is shown partially broken away.
Figure 4:
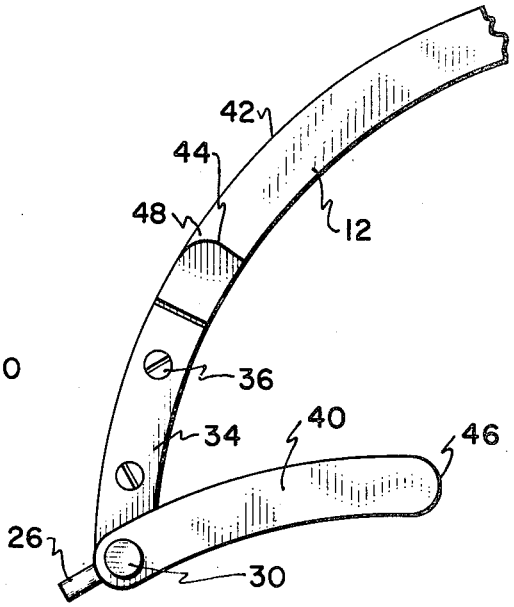
FIG. 4 is an end view of a segment of the clamping saddle of the invention showing the register pins turned to a loading position.
Figure 5:
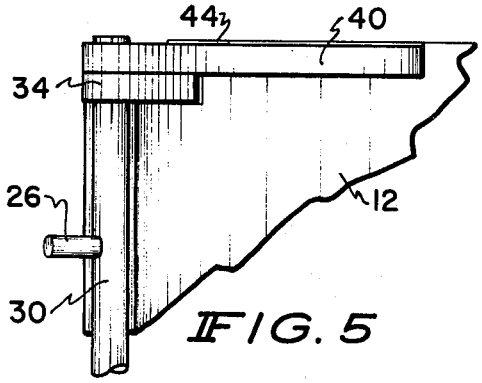
FIG. 5 is a plan elevation view of the clamping saddle segment shown in FIG. 4.
Figure 6:
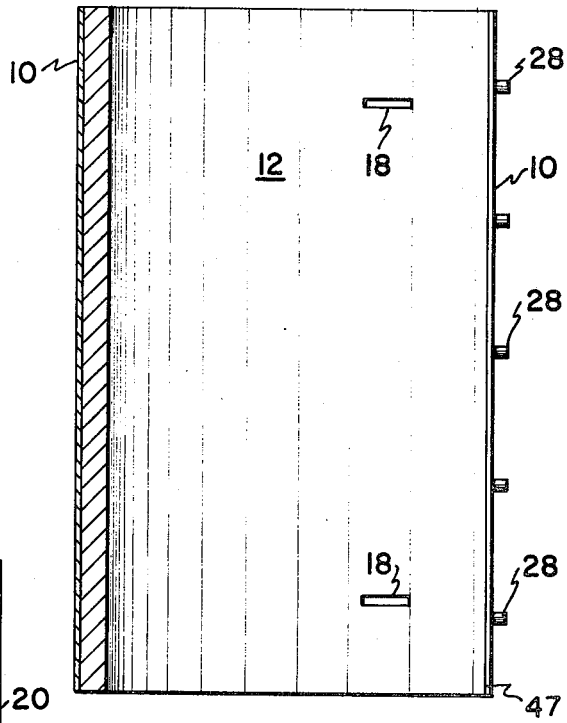
FIG. 6 is a sectional view taken in the plane of line 6—6 of FIG. 2 looking in the direction of the arrows.
Figure 7:
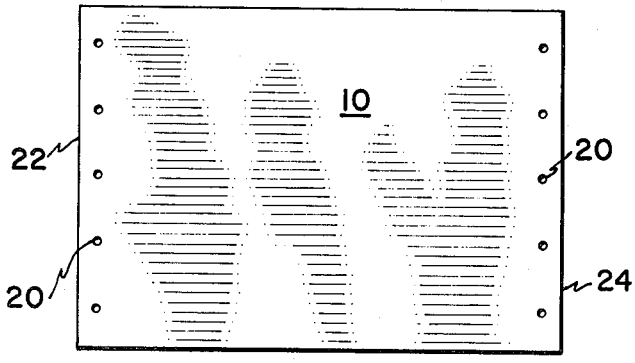
FIG. 7 is a plan elevation view of a flexible printing plate ready for installation on the clamping saddle of the invention.

As best shown in FIGS. 3–5, a support bar 30 is rotatably mounted along one side edge 32 of saddle 12 by journaling the bar 30, preferably proximate its opposite ends, in support brackets 34 fixedly secured to the opposite ends of saddle 12 in a conventional fashion with, for example, screws 36 threaded into saddle 12. Brackets 34 are preferably secured in recess openings 38 formed in saddle 12. Handles, i.e., levers, 40 are fixedly attached to the opposite ends of bar 30 for rotating said bar so that the register pins 26 attached thereto can be positioned in a flexible plate loading position to extend outwardly away from the outside face 42 of saddle 12 as shown in FIG. 4, or the pins 26 can be turned to a locking position extending outwardly away from saddle edge 32 as best shown in FIG. 1.

Handles 40 are preferably fitted substantially entirely within recesses 44 formed in saddle 12. Most preferably, recesses 44 are shaped to coact with the end 46 of handles 40 to prevent the handles from rotating to a position beyond outside saddle face 42. Register pins 26 are preferably positioned in the locking position when handles 40 are substantially aligned with saddle 12 as shown in FIG. 1. Accordingly, when said handles are so positioned they are prevented from extending beyond saddle face 42 by coacting with outwardly projecting lips 48 of recesses 44 and said handles are prevented from rotating to the loading position by their coaction with printing cylinder 14. It is to be noted that while the use of a plurality of handles 40 has been described herein a single handle or other rotation means can be used.

Register pins 28 are secured to the side edge 47 of saddle 12 opposite saddle side edge 32 and are positioned to extend outwardly away from said side edge 47. A plurality of pins 26 and 28 are secured to bar 30 and saddle side edge 47 respectively with 3 to 9 pins preferably being used on each side of the saddle. The pins 26 and 28 are preferably about ⅛ to 3/16 inches in diameter and respectively extend about ⅛ to 3/16 inches outwardly away from bar 30 and saddle side edge 46.

In using the clamping saddle of the invention a standard flexible relatively thin printing plate is provided with register pin openings 20 along the plate's opposite side edges 22 and 24 at a spacing suitable for receiving the clamping saddle's register pins 26 and 28. Pin openings 20 positioned adjacent plate side edge 24 are fitted over register pins 28 and plate 10 is wrapped around saddle 12 wherein the plate's back side is positioned on the saddle's front face 42. Handles 40 are then rotated away from the back side of saddle 12 as shown in FIG. 4 until register pins 26 are positioned to extend outwardly away from face 42. When thus positioned the pin openings 20 along side edge 22 of flexible plate 10 are substantially aligned with pins 26 wherein said pins 26 are passed through openings 20. Handles 40 are then rotated to their locking position i.e., positioned within recesses 44, such that handle ends 46 butt against outwardly projecting retainer lip 48. When handles 40 are thus positioned a locking tension is applied to flexible plate 10 to securely hold it against saddle face 42 for printing purposes. The clamping saddle with printing plate affixed thereto is then secured to the printing cylinder 14 of a rotating printing press as heretofore described to securely hold handles 40 in a locked position until saddle 12 is again removed from cylinder 14.

I claim as my invention:

1. A clamping device for securing a thin flexible printing plate to a rotary printing press having a rotatable cylinder, said clamping device comprising:

a semi-cylindrically shaped saddle plate having opposed concave and convex faces and first and second longitudinally extending side edges, and adapted to be secured with its concave face flush against the surface of said cylinder of said rotary press with said first and second side edges substantially parallel to the axis of said cylinder while supporting said thin flexible printing plate on the convex face of said saddle plate;

securing means attached to and positioned along the first side edge of said saddle plate for securing a first edge of said thin flexible plate to said saddle plate;

a support member journaled to and positioned along the second longitudinally extending side edge of said saddle plate;

a plurality of outwardly extending register pins secured to said support member and positioned to coact with register pin openings formed along a second edge opposite said first edge of said thin flexible plate;

hand operated rotation means secured to said support member at one end of said support member for rotating said support member in the support member journals; and a recess formed in said saddle plate proximate said second longitudinally extending side edge and sized to receive a handle therein, said rotation means comprising a handle fixedly secured to said support member at one end thereof and sized to be received substantially entirely within said recess.

2. The clamping device of claim 1 wherein said recess is open on the concave face of the saddle plate to receive said handle but sufficiently closed on the convex face of the saddle plate to prevent said handle from moving outwardly beyond said convex face of said saddle plate.

3. A clamping device for securing a thin flexible printing plate to a rotary printing press having a rotatable cylinder, said clamping device comprising;

a semi-cylindrically shaped saddle plate having opposed concave and convex faces and first and second longitudinally extending side edges, and adapted to be secured with its concave face flush against the surface of said cylinder of said rotary press with said first and second side edges substantially parallel to the axis of said cylinder while supporting said thin flexible printing plate on the convex of said saddle plate;

securing means attached to and positioned along the first side edge of said saddle plate for securing a first edge of said thin flexible plate to said saddle plate, said securing means comprising a first plurality of register pins positioned to extend outwardly away from said first side edge of said saddle plate to coact with register pin openings formed along the first edge of said thin flexible plate;

a support member journaled to and positioned along the second longitudinally extending side edge of said saddle plate;

a second plurality of outwardly extending register pins secured to said support member and positioned to coact with register pin openings formed along a second edge opposite said first edge of said thin flexible plate;

hand operated rotation means secured to said support member at one end of said support member for rotating said support member in the support member journals; and a recess formed in said saddle plate proximate said second longitudinally extending side edge and sized to receive a handle therein, said rotation means comprising a handle fixedly secured to said support member at one end thereof and sized to be received substantially entirely within said recess formed in said saddle plate.

4. The clamping device of claim 3 wherein said recess is open on the concave face of the saddle plate to receive said handle but sufficiently closed on the convex face of the saddle plate to prevent said handle from moving outwardly beyond said convex face of said saddle plate.

5. The clamping device of claim 4 wherein said rotation means includes first and second handles secured to said support member proximate the opposite ends of said support member.

6. For use with a printing press having a rotatable cylinder, the combination of a thin flexible printing plate having first and second longitudinally extending opposite side edges, and a clamping device comprising:

a semi-cylindrically shaped saddle plate having opposed concave and convex faces adapted to be secured with its concave face flush against the surface of said rotary press cylinder while supporting said thin flexible printing plate on the convex face of said saddle plate between first and second longitudinally extending side edges of said saddle plate, said saddle plate side edges being substantially parallel to the axis of said cylinder;

securing means attached to and positioned along the first side edge of said saddle plate for securing the first side edge of said thin flexible plate to said saddle plate;

a support member journaled to and positioned along the second longitudinally extending side edge of said saddle plate;

a plurality of outwardly extending register pins secured to said support member and positioned to coact with register pin openings formed in and along the second side edge of said thin flexible plate;

hand operated rotation means secured to said support member at one end of said support member for rotating said support member in the support member journals to a position such that said register pins extend outwardly away from said second side edge of said saddle plate to lock said thin flexible printing plate against said convex face of said saddle plate; and a recess formed in said saddle plate proximate said second longitudinally extending side edge and sized to receive a handle therein, said rotation means comprising a handle fixedly secured to said support member at one end thereof and sized to be received substantially entirely within said recess formed in said saddle plate when said flexible printing plate is locked against the convex face of said saddle plate.

7. The combination of claim 6 wherein said recess is open on the concave face of the saddle plate to receive said handle but sufficiently closed on the convex face of the saddle plate to prevent said handle from moving outwardly beyond said convex face of said saddle plate and said handle is held by said cylinder of said rotary press from moving inwardly beyond the concave face of said saddle plate when said saddle plate is operatively mounted on said cylinder.

8. For use with a printing press having a rotatable cylinder, the combination of a thin flexible printing plate having first and second longitudinally extending opposite side edges, and a clamping device comprising:

a semi-cylindrically shaped saddle plate having opposed concave and convex faces adapted to be secured with its concave face flush against the surface of said rotary press cylinder while supporting said thin flexible printing plate on the convex face of said saddle plate between first and second longitudinally extending side edges of said saddle plate, said saddle plate side edges being substantially parallel to the axis of said cylinder;

securing means attached to and positioned along the first side edge of said saddle plate for securing the first side edge of said thin flexible plate to said saddle plate, said securing means comprising a first plurality of register pins positioned to extend outwardly away from the first side edge of said saddle plate to coact with register pin openings formed along the first side edge of said thin flexible plate;

a support member journaled to and positioned along the second longitudinally extending side edge of said saddle plate;

a second plurality of outwardly extending register pins secured to said support member and positioned to coact with register pin openings formed in and along the second side edge of said thin flexible plate;

hand operated rotation means secured to said support member at one of said support member for rotating said support member in the support member journals to a position such that said register pins extend outwardly away from said second side edge of said saddle plate to lock said thin flexible printing plate against said convex face of said saddle plate; and a recess which is formed in said saddle plate proximate said second longitudinally extending side edge and sized to receive a handle therein, said rotation means comprising a handle fixedly secured to said support member at one end thereof which is sized to be received substantially entirely within said recess formed in said saddle plate when said flexible printing plate is locked against the convex face of said saddle plate.

9. The combination of claim 8 wherein said recess is open on the concave face of the saddle plate to receive said handle but sufficiently closed on the convex face of the saddle plate to prevent said handle from moving outwardly beyond said convex face of said saddle plate and said handle is held by said cylinder of said rotary press from moving inwardly beyond the inside face of said saddle plate when said saddle plate is operatively mounted on said cylinder.

10. The combination of claim 9 wherein said rotation means includes first and second handles secured to said support member proximate the opposite ends of said support member.

* * * * *